US007384329B2

(12) United States Patent
Rutkiewicz et al.

(10) Patent No.: US 7,384,329 B2
(45) Date of Patent: Jun. 10, 2008

(54) COOLANT DELIVERY SYSTEM FOR GRINDING TOOLS

(75) Inventors: Brian P. Rutkiewicz, Worcester, MA (US); Ken J. Hart, Travelers Rest, SC (US)

(73) Assignee: Saint-Gobain Abrasives Technology Company, Worcester, MA (US)

( * ) Notice: Subject to any disclaimer, the term of this patent is extended or adjusted under 35 U.S.C. 154(b) by 0 days.

(21) Appl. No.: 11/438,960

(22) Filed: May 23, 2006

(65) Prior Publication Data

US 2007/0275636 A1 Nov. 29, 2007

(51) Int. Cl.
*B24B 55/02* (2006.01)
*B24B 1/00* (2006.01)

(52) U.S. Cl. ..... 451/450; 451/60; 451/541

(58) Field of Classification Search ..... 451/11, 451/449, 450, 446, 60, 7, 53, 541
See application file for complete search history.

(56) References Cited

U.S. PATENT DOCUMENTS

| | | | | |
|---|---|---|---|---|
| 3,345,281 | A | 10/1967 | Falls | |
| 3,683,566 | A | 8/1972 | Walters | |
| 3,780,476 | A | 12/1973 | Sipe | |
| 4,791,760 | A | 12/1988 | Noll | |
| 4,854,087 | A * | 8/1989 | Riha | 451/541 |
| 5,129,190 | A * | 7/1992 | Kovach et al. | 451/53 |
| 5,259,148 | A * | 11/1993 | Wiand | 451/450 |
| 5,345,726 | A | 9/1994 | Gach | |
| 5,582,540 | A * | 12/1996 | Su et al. | 451/259 |
| 5,738,572 | A | 4/1998 | Giebmanns | |
| 5,895,317 | A | 4/1999 | Timm | |
| 5,951,378 | A | 9/1999 | Miller et al. | |
| 5,964,649 | A * | 10/1999 | Bergqvist et al. | 451/54 |
| 5,993,297 | A | 11/1999 | Hyatt et al. | |
| 5,997,597 | A | 12/1999 | Hagan | |
| 6,224,473 | B1 | 5/2001 | Miller et al. | |

FOREIGN PATENT DOCUMENTS

| | | |
|---|---|---|
| DE | 1 321 232 A1 | 6/2003 |
| EP | 0581 507 A1 | 7/1993 |
| EP | 119 522 4 | 4/2002 |
| JP | 60167769 | 8/1985 |
| JP | 6155293 | 6/1994 |
| JP | 7276243 | 10/1995 |
| JP | 10034542 | 2/1998 |
| JP | 10193271 | 7/1998 |
| JP | 11347912 | 12/1999 |

* cited by examiner

*Primary Examiner*—Dung Van Nguyen
(74) *Attorney, Agent, or Firm*—Sampson & Associates, P.C.

(57) ABSTRACT

An abrasive grinding wheel having an annular grinding face depending from a substantially circular body includes a tubular inner wall which defines an axial bore configured to convey coolant in a downstream direction therethrough. The inner wall is coupled to a concave body portion terminating at an inner periphery of the annular grinding face. A flange having an outer periphery disposed, in representative embodiments, within about 20 mm of the inner periphery of the grinding face, is superposed with the concave body portion, to define a fluid flow passage between the flange and the concave body portion. The fluid flow passage is in fluid communication with the axial bore and with the grinding face, so that during operable rotation of the grinding wheel, coolant flowing downstream through the bore is conveyed radially outward into the fluid flow passage for delivery to the grinding face.

35 Claims, 4 Drawing Sheets

COOLANT DELIVERY SYSTEM FOR GRINDING TOOLS

BACKGROUND OF THE INVENTION

1. Field of the Invention

This invention relates to abrasive tools, and more particularly to grinding wheels and methods adapted to replace milling operations used for the removal of large quantities of material from the surface of workpieces.

2. Background Information

Components intended for complex, precision assemblies such as automobiles and other industrial products must often be manufactured to stringent quality standards, including tight dimensional tolerances and surface finish requirements. Some of the tightest standards are associated with the manufacture of vehicular components. In the initial finishing step, these components are generally machined by common processes such as fly cutting or high speed milling using milling heads having hardened ceramic inserts, such as silicon nitride, tungsten carbide or polycrystalline diamond (PCD). To help insure that the finished surface is adequately smooth and flat following machining, a multi-step approach is often used, which includes a rough pass and one or more finish passes with precision grinding tools. With new high speed machining centers, coolant is supplied at relatively high pressure and low volume through the spindle (through an axial bore) to the center of the cutting head. Because machine cutting processes are very slow, compared to grinding processes, the nature of the coolant delivery system is not critical to the effectiveness of the cutting operation.

These milling processes have been used to make vehicular engines, transmission components, pump housings, solenoid valves, power steering components and bearing and mating faces for use in automobiles and other vehicles, appliances, machines and other manufactured items. In general, machine tool cutting processes (also known as "machining" or "milling") have been used in any application or operation where the workpiece must have a precision flat, parallel surface. In nearly all of these applications and operations, the milling process must be followed by a grinding process to reduce surface roughness to a finer level than one can achieve with a milling process.

In many operations, the workpieces have had to be further processed, such as with a cup-type face grinding wheel on a conventional grinding machine, to meet these standards. Disadvantageously, this extra grinding step, including the extra tool change and set up, tends to increase the time and expense of workpiece fabrication.

One attempt to reduce the number of discrete fabrication steps has involved equipping the milling machines with grinding wheels in lieu of milling cutters to carry out a surface grinding step in lieu of a face milling step. In this manner, it was anticipated that both the rough and finish milling operations could be eliminated in favor of one or more grinding operations, to therefore eliminate the need for extra tool changes, multiple tool setups, etc. A drawback of this approach, however, is that the relatively high pressure, centrally (i.e., spindle) fed coolant flow provided by the milling machines tends to be incompatible with grinding wheels, which typically rely on lower pressure, peripherally fed coolant flow.

A need therefore exists for an improved tool and/or method for effecting grinding operations using conventional spindle-cooled milling machines.

SUMMARY OF THE INVENTION

In one aspect of the invention, an abrasive grinding tool includes a grinding wheel having an annular grinding face depending from a substantially circular body configured for being operably engaged by a machine spindle for rotation about a central axis. The body has a tubular inner wall defining an axial bore configured to convey coolant in a downstream direction therethrough from a proximal end to a distal end. The inner wall is coupled to a concave body portion terminating at an inner periphery of the annular grinding face. A flange having an outer periphery disposed within about 20 mm of the inner periphery of the grinding face, is disposed within the concave body portion, in superposed orientation therewith, to define a fluid flow passage between the flange and the concave body portion. The fluid flow passage is in fluid communication with the axial bore and with the grinding face, so that during operable rotation of the grinding wheel, coolant flowing downstream through the bore is conveyed radially outward into the fluid flow passage for delivery to the grinding face.

In another aspect of the invention, a method for grinding a workpiece to form a flat surface, includes providing an abrasive face grinding wheel having an annular grinding face depending from a substantially circular body, the body configured for being operably engaged by a machine tool spindle, and having a tubular inner wall defining an axial bore configured to convey coolant in a downstream direction therethrough. The inner wall is coupled to a concave body portion terminating at an inner periphery of the annular grinding face. A flange having a periphery disposed within about 20 mm of the inner periphery of the grinding face is superposed within the concave body portion, so that the flange and the concave body portion define a fluid flow passage therebetween, in fluid communication with the axial bore and with the grinding face. The method further includes orienting the central axis at a predetermined angle $\alpha$ relative to the workpiece, rotating the grinding wheel about the central axis, and delivering coolant flow downstream through the bore, for conveyance radially outward through the fluid flow passage for delivery to the grinding face in a substantially laminar flow. The grinding wheel is then translated towards the workpiece along a tool path parallel thereto, so that the grinding face engages and removes material from the workpiece.

In yet another aspect of the invention, a grinding system includes an abrasive face grinding wheel having an annular grinding face depending from a substantially circular body. The body is configured for being operably engaged by a machine tool spindle for rotation about a central axis, and has a tubular inner wall defining an axial bore configured to convey coolant in a downstream direction therethrough. The inner wall extends to a concave body portion that terminates at an inner periphery of the annular grinding face. A flange is superposed within the concave body portion to define a fluid flow passage therebetween. A plurality of channels located within the grinding face extends radially inward of the periphery of the flange, in fluid communication with the grinding face and with the fluid flow passage. During operable rotation of the grinding wheel, coolant flowing downstream through the bore is conveyed radially outward into the fluid flow passage and into the channels for delivery to the grinding face.

In still another aspect of the invention, a method for grinding a workpiece to form a flat surface, includes providing an abrasive face grinding wheel having an annular grinding face depending from a substantially circular body.

The body is configured for being operably engaged by a machine tool spindle for rotation about a central axis, and includes a tubular inner wall defining an axial bore configured to convey coolant in a downstream direction therethrough from a proximal end to a distal end thereof. The inner wall is coupled to a concave body portion terminating at an inner periphery of the annular grinding face. A flange is disposed within the concave body portion, in superposed orientation therewith, so that the flange and the concave body portion define a fluid flow passage therebetween, the fluid flow passage being in fluid communication with the axial bore and with the grinding face. The flange has an outer periphery disposed sufficiently close to an inner periphery of the grinding face to maintain laminar coolant flow at a point of grinding. The method further includes orienting the central axis at a predetermined angle $\alpha$ relative to the workpiece, and rotating the grinding wheel about the central axis. Coolant flow is delivered downstream through the bore, for conveyance radially outward through the fluid flow passage for delivery of laminar coolant flow to the point of grinding. The grinding wheel is translated towards the workpiece along a tool path parallel thereto, so that the grinding face engages and removes material from the workpiece.

The above and other features and advantages of this invention will be more readily apparent from a reading of the following detailed description of various aspects of the invention taken in conjunction with the accompanying drawings.

DETAILED DESCRIPTION OF THE PREFERRED EMBODIMENTS

Figure 1:
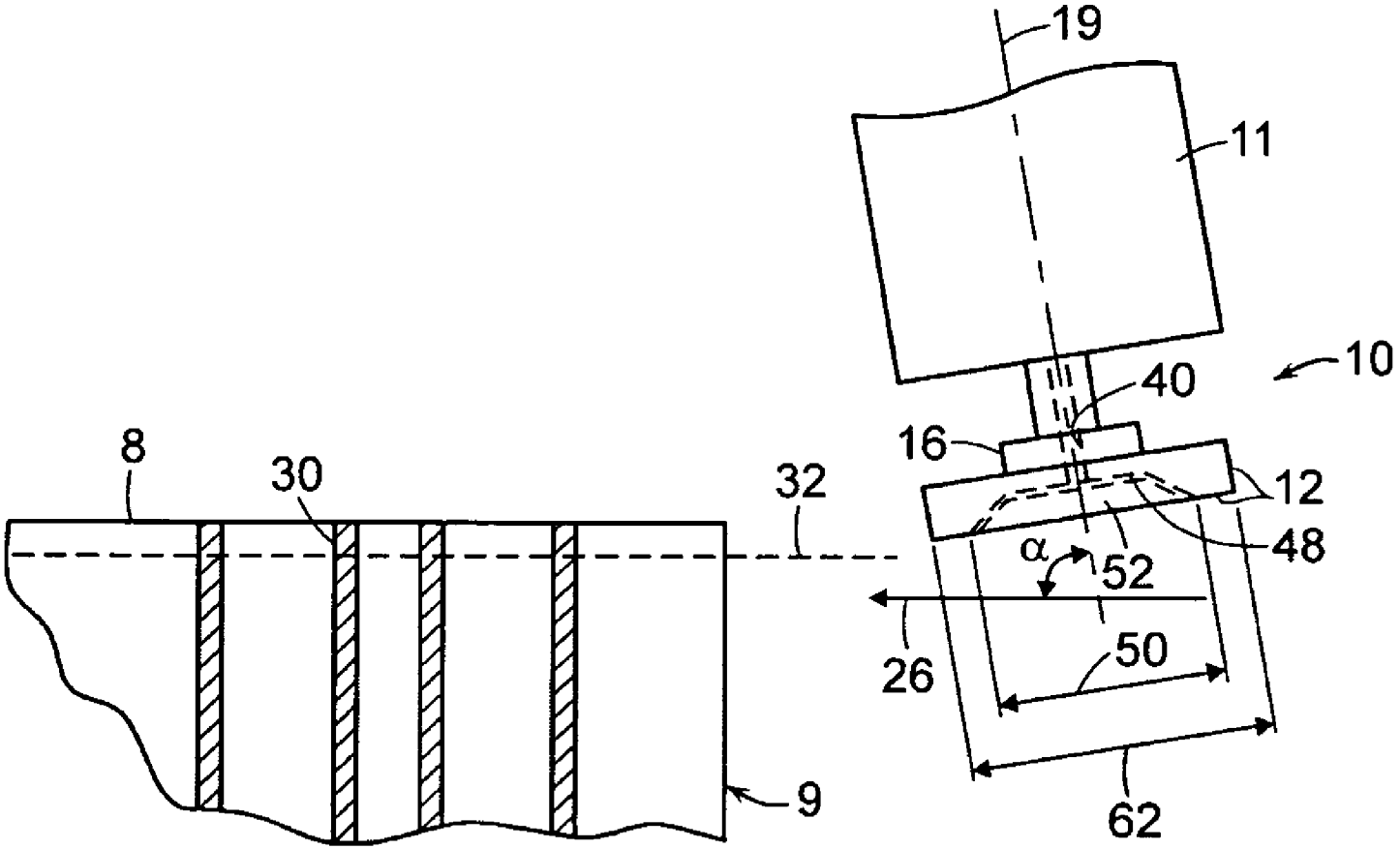
FIG. 1 is an elevational schematic view of a grinding wheel during a step in the process of machining an exemplary workpiece, in accordance with an embodiment of the present invention.

An aspect of the invention was the realization that when grinding wheels were used on many conventional milling machines, much of the coolant fed axially through the spindle thereof either failed to reach, or inconsistently reached, the grinding zone of the wheel. While not wishing to be tied to a particular theory, it was hypothesized that the relatively large workpiece contact area of the grinding wheels as compared to milling cutters, in combination with the turbulence and entrained air of the high pressure, axially fed coolant flow, and/or the relatively low volume of this flow, effectively inhibited the ability of the coolant to migrate radially outward through the grinding zone, resulting in coolant deprivation.

Embodiments of the subject invention thus include an improved apparatus and method for machining flat a workpiece (FIG. 1) using a grinding wheel fitted onto a conventional milling machine of the type having an axial (spindle) coolant feed. These embodiments include a grinding wheel 10 (FIG. 1) having an annular grinding element or face 12 (FIGS. 2A, 2B) disposed concentrically with the wheel on a body 16 (FIG. 1), and having an axial bore 40 to convey coolant therethrough. A flange 52 disposed within a concave portion 48 of body 16, serves to direct coolant radially outward from the bore 40 for delivery to the grinding face 12 in a relatively evenly distributed, substantially laminar flow. In particular embodiments, a series of channels 34 (FIG. 3) may also extend from the face 12 into concave body portion 48 to facilitate this flow. As will be discussed in greater detail below, this improved coolant flow has generated significant improvements in tool life relative to conventional approaches.

In a particular embodiment, face 12 includes a single layer of abrasive 18 (FIG. 4) bonded (e.g., electroplated or brazed) onto body 16. Alternatively, face 12 may include abrasive segments made from a bond matrix (e.g., vitrified bond) containing conventional abrasive grain or superabrasive grain (e.g., diamond or cubic boron nitride (CBN)). Still further, grinding face 12 may include metal matrix composite (MMC) segments. Grinding face 12 may be fabricated as a single, annular component, or alternatively, may comprise a series of segments disposed in radially spaced relation to one another in a conventional manner.

During a representative operation, grinding wheel 10 (FIG. 1) is oriented with its axis of rotation 19 at a predetermined angle $\alpha$ (e.g., typically 0 to 2 degrees) relative to workpiece 8. The wheel is then translated along a tool path 26 parallel to the workpiece so that grinding face 12 engages the workpiece to remove material and to apply the requisite surface finish thereto.

Throughout this disclosure, the term "axial" when used in connection with a portion of a grinding wheel, refers to a direction substantially parallel to axis of rotation 19 as shown in FIG. 1. The term "downstream" refers to the direction of coolant fluid flow through the tool to the grinding face of embodiments of the present invention. The term "transverse" refers to a direction relative to a component described herein, which is orthogonal to the downstream direction of coolant fluid flow therethrough. The term "laminar" or "laminar flow" is used in its conventional fluid mechanics sense, to refer to the streamline (non-turbulent) flow of a viscous, incompressible fluid in which fluid particles travel along well-defined separate lines.

Referring now to the Figures in detail, as shown in FIG. 1, in various embodiments, wheel 10 may be fabricated as an industry standard face grinding wheel, such as a Type 6, or flat cup wheel, having an annular grinding face 12 depending from a body 16. Thus, as shown, grinding wheel 10 is utilized in a conventional face grinding manner, in which its axis of rotation 19 is oriented at a predetermined angle $\alpha$ to surface 8. While maintaining angle $\alpha$ constant, the wheel is translated or moved along tool path 26 to engage and machine workpiece 9 to a predetermined height 32. In a particular embodiment, angle $\alpha$ is approximately 88 or 89 degrees as shown. Alternatively, wheel 10 may be used in any number of operating modes, such as conventional multiple pass, orbital path, etc. Also, angle $\alpha$ may be 90 degrees (not shown) to orient grinding face 12 parallel to surface 8, in which diametrically opposed portions of grinding face 12 may contact the workpiece simultaneously.

Figure 2B:
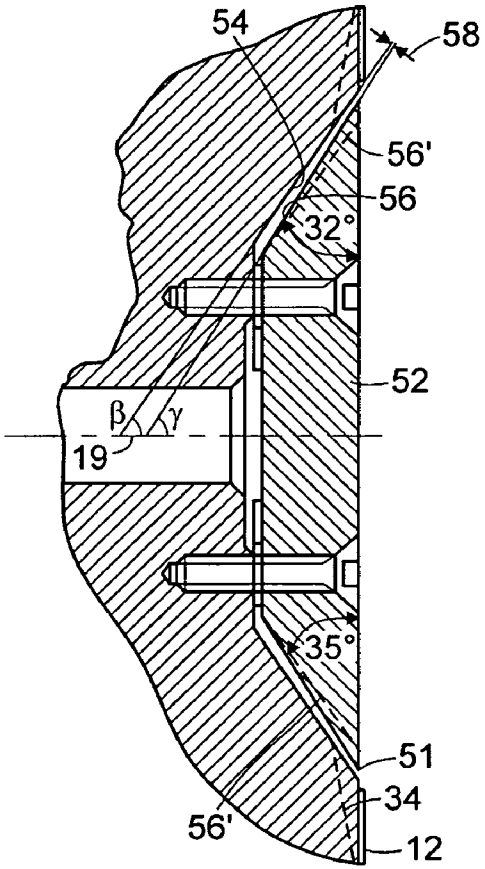
FIG. 2B is a side elevational cross-sectional view, on a further enlarged scale, of a portion of the grinding wheel of FIG. 2A.
Figure 2A:
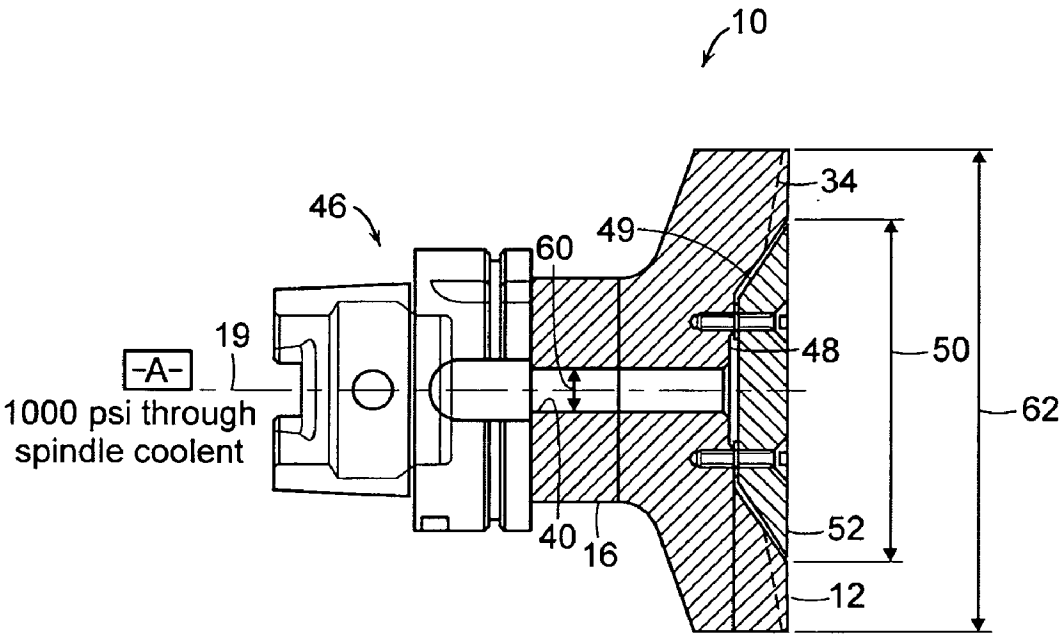
FIG. 2A is a side elevational cross-sectional view, on an enlarged scale, of the grinding wheel of FIG. 1.

Turning now to FIGS. 2A-2B, embodiments of grinding wheel 10 are provided with a conventional collar 46 of the type used to facilitate engagement with a spindle of a milling machine 11 (FIG. 1). Collar 46 is fastened to, or integrally formed with, an end of body 16 opposite that of grinding face 12. As also shown, body 16 includes a tubular inner wall which defines an axial bore 40 configured to convey coolant in a downstream direction therethrough from a similarly disposed bore within collar 46. At a downstream end of the bore 40, the inner wall of body 16 extends radially outward and downstream to define a concave body portion 48 which terminates at an inner periphery, e.g., inner diameter (ID) 50 of annular grinding face 12.

A flange 52 is sized and shaped for receipt within concave body portion 48, while defining a predetermined space or gap therebetween, which serves as a fluid flow passage 49. Flange 52 is further sized and shaped so that it does not protrude axially (e.g., in the downstream direction) beyond the plane of grinding face 12 as shown. The flange 52 is typically provided with an outer diameter (OD) which is less than, but within about 40 mm, of ID 50 of grinding face 12, to provide a gap 58 of about 20 mm or less. In various embodiments, the gap 58 is 10 mm or less, while in other embodiments, the flange periphery is sized to provide a gap 58 of 5 mm or less.

Flange 52 may be secured within concave body portion 48 in any convenient manner, such as by mechanically fastening the flange to the body as shown. However, nominally any other approach familiar to those skilled in the art may be used. For example, the flange and body portion may be fabricated unitarily, e.g., as a one-piece component by molding or casting, and/or with the fluid flow passage 49 being machined therein, e.g., as one or more discrete pathways. Alternatively, rather than fastening it to the body, flange 52 may be fastened directly to the grinding machine, e.g., to a conventional tool adapter, or to the spindle of the grinding machine such as by the use of a rod passing through bore 40.

The fluid flow passage 49 is configured so that during operational rotation of the grinding wheel about axis 19, coolant flowing downstream through bore 40 is conveyed radially outward through the passage, to the grinding face in a substantially laminar flow. This laminar flow may be accomplished, at least in part, by configuring the flange to be at least as close to concave body portion 48 at a radially outer portion, as it is at a radially inner portion thereof.

For example, as best shown in FIG. 2B, a particular embodiment of grinding wheel 10 includes a concave body portion 48 having a frusto-conical wall 54 disposed at an acute angle β to central axis 19. Flange 52 also includes a frusto-conical wall (56, 56'), which is superposed with wall 54 of body portion 48. In some embodiments, the wall (shown in phantom at 56') may be disposed parallel to wall 54. In other embodiments, however, wall 56 is disposed at an acute angle γ to central axis 19, which is larger than angle β. Thus, in this latter configuration flange 52 is disposed progressively closer to body portion 48 in the downstream direction (e.g., towards the periphery of the flange). Controlling the size of fluid flow passage 49 in this manner has been shown to reduce turbulence and entrained air within the coolant flow, to improve tool life. While not wishing to be tied to any particular theory, as mentioned hereinabove, it is believed that this relative reduction in turbulence and entrained air, (and concomitant increase in laminar flow) increases density and improves pressure distribution of the coolant flow to more evenly distribute the coolant into and through the grinding zone. In particular embodiments, the smallest cross-sectional area of passage 49 transverse to the downstream flow direction, (e.g., as defined by the gap 58 between body portion 48 and flange 52) may range from about 75 percent to about 300 percent of the smallest transverse cross-sectional area of axial bore 40. This percentage will tend to be lower for smaller wheel diameters, and higher for larger diameters, such as shown in the exemplary values in the following Tables IA & IB.

TABLE IA

| Wheel No. | Wheel Diameter: inch (cm) | Flange Diameter: inch (cm) | Min gap: inch (cm) | Max Gap: inch (cm) | Min Outlet area: $in^2$ ($cm^2$) |
|---|---|---|---|---|---|
| 1 | 4(10.1) | 3.06(7.8) | 0.0197(0.05) | 0.0394(0.10) | 0.0943(0.61) |
| 2 | 4.5(11.4) | 3.56(9.0) | 0.0197(0.05) | 0.0394(0.10) | 0.1099(0.71) |
| 3 | 5(12.7) | 4.06(10.3) | 0.0197(0.05) | 0.0394(0.10) | 0.1252(0.81) |
| 4 | 5.85(14.9) | 4.91(12.5) | 0.020(0.05) | 0.039(0.01) | 0.1515(0.98) |
| 5 | 6(15.2) | 5.06(12.9) | 0.0197(0.05) | 0.0394(0.10) | 0.1562(1.01) |
| 6 | 7(17.8) | 6.06(15.4) | 0.0197(0.05) | 0.0394(0.10) | 0.1871(1.21) |
| 7 | 8(20.3) | 7.06(17.9) | 0.0197(0.05) | 0.0394(0.10) | 0.2180(1.41) |
| 8 | 9(22.9) | 8.06(20.5) | 0.0197(0.05) | 0.0394(0.10) | 0.2489(1.61) |
| 9 | 10(25.4) | 9.06(23.0) | 0.0197(0.05) | 0.0394(0.10) | 0.2798(1.81) |
| 10 | 12(30.5) | 11.06(28.0) | 0.0197(0.05) | 0.0394(0.10) | 0.3417(2.20) |

TABLE IB

| Wheel No. | Max Outlet area: $in^2$ ($cm^2$) | inlet (bore) diameter: inch (cm) | inlet area: $in^2$ ($cm^2$) | Relationship Min | Relationship Max |
|---|---|---|---|---|---|
| 1 | 0.1880(1.21) | 0.394(1.0) | 0.122(0.79) | 77% | 154% |
| 2 | 0.2191(1.41) | 0.394(1.0) | 0.122(0.79) | 90% | 180% |
| 3 | 0.2499(1.61) | 0.394(1.0) | 0.122(0.79) | 103% | 205% |
| 4 | 0.3024(1.95) | 0.394(1.0) | 0.122(0.79) | 124% | 248% |
| 5 | 0.3117(2.01) | 0.394(1.0) | 0.122(0.79) | 128% | 256% |
| 6 | 0.3735(2.41) | 0.394(1.0) | 0.122(0.79) | 153% | 306% |
| 7 | 0.4354(2.81) | 0.394(1.0) | 0.122(0.79) | 179% | 357% |
| 8 | 0.4972(3.21) | 0.551(1.4) | 0.238(1.54) | 104% | 209% |
| 9 | 0.5591(3.61) | 0.551(1.4) | 0.238(1.54) | 117% | 234% |
| 10 | 0.6828(4.41) | 0.551(1.4) | 0.238(1.54) | 143% | 286% |

As best shown in FIG. 2B, in a representative embodiment, this smallest cross-sectional area of passage 49 is provided by gap 58 located at the periphery of flange 52, adjacent the inner diameter (ID) of annular grinding face 12. However, this smallest cross-sectional area may be disposed upstream of peripheral gap 58 in some embodiments. Regardless of the particular location of this smallest cross-sectional area, controlling the size of passage 49 in this manner tends to promote collection or compression of the coolant to further dissipate turbulence and entrained air, and enhance the uniformity of density and pressure distribution, prior to exiting passage 49, for improved coolant delivery to the grinding zone.

Figure 2D:
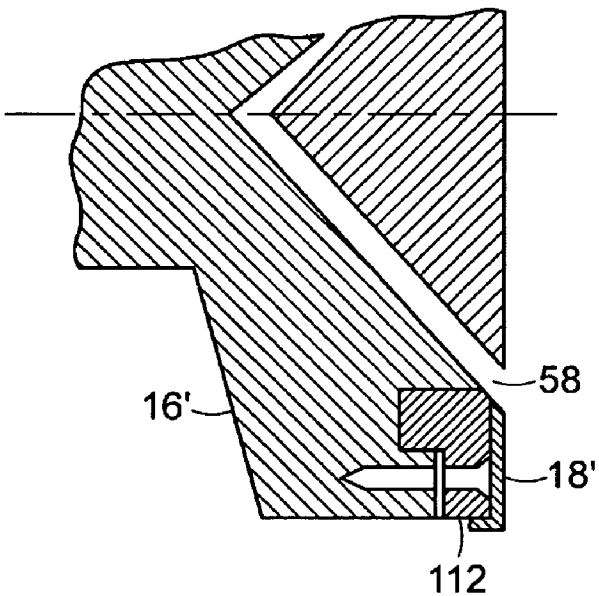
FIG. 2D is a side elevational cross-sectional view, on an enlarged scale, of a portion of the embodiment of FIG. 2C.
Figure 2C:
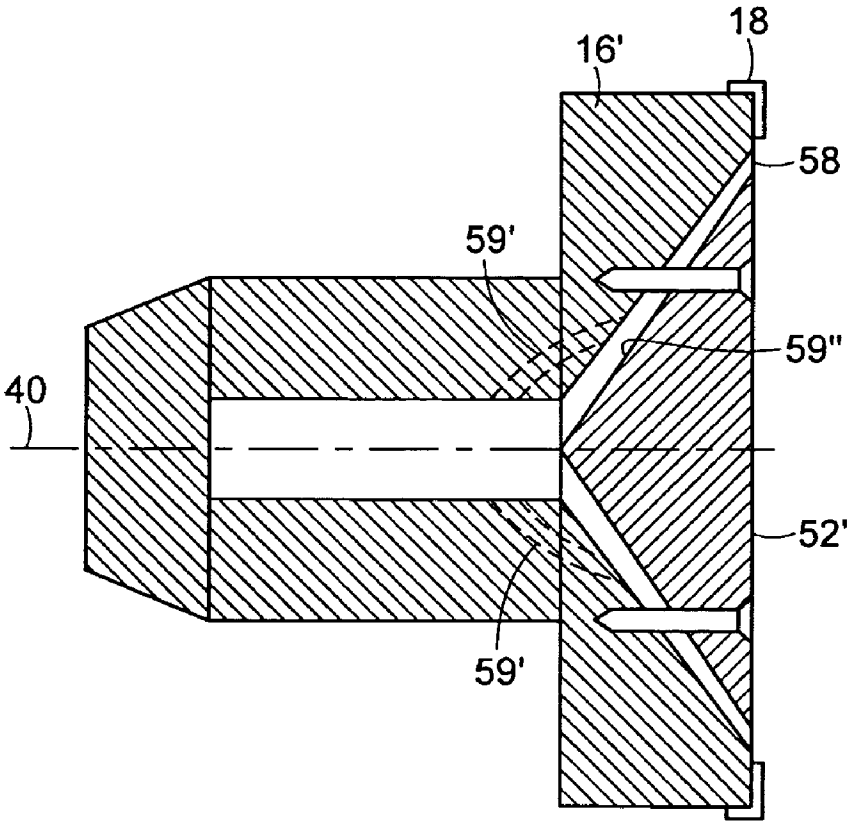
FIG. 2C is a side elevational cross-sectional view of an alternate embodiment of the present invention.

As also shown, passage 49 includes a medial transition portion 59 disposed between bore 40 and gap 58. This medial portion 59 may be configured with substantially any geometry, including the substantially circular configuration shown in cross-section. Alternatively, as shown in FIG. 2C, this portion may take the form of one or more discrete pathways extending through body 16 (e.g., as shown in phantom at 59') or which simply extend continuously between body 16 and flange 52', along either curved or nominally straight trajectories from bore 40 to gap 58 as shown at 59".

In various embodiments, medial portions 59, 59', 59" may be provided with a collective transverse cross-sectional area which is larger than that of bore 40 (and optionally, that of gap 58). It is believed that this relatively larger medial portion enables the coolant to momentarily collect, to further facilitate the dissipation of turbulence and entrained air, prior to exiting passage 49 via gap 58.

Figure 3:
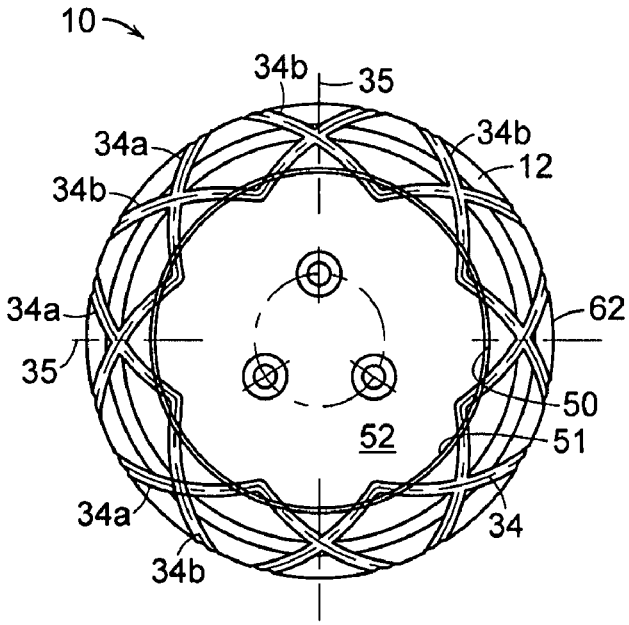
FIG. 3 is a front elevational view of the grinding wheel of FIG. 2A.

As another option, embodiments of the present invention may be provided with channels 34, such as shown in phantom in FIGS. 2A and 2B, and in FIG. 3. Although channels 34 may be used without flange 52, in particular embodiments they are used with the flange as shown, to further enhance coolant flow. As best shown in FIGS. 2A and 2B, channels 34 extend along, or define, a notional frusto-conical surface disposed at an acute angle to axis 19. The channels provide fluid communication between grinding face 12 and fluid flow passage 49. In various embodiments, this fluid communication is accomplished by extending channels 34 from a location radially inward of ID 50 of face 12 (and inward of the periphery 51 of flange 52, FIGS. 2B, 3), to a location radially outward of the flange. In particular embodiments, the channels 34 extend completely through grinding face 12 to the outer diameter (OD) 62 thereof. In particular embodiments, the total cross-sectional area of channels 34 may be within a range of 50 to 150 percent that of the inlet area (e.g., cross-section of bore 40). Exemplary dimensions of channels 34, for a wheel having a 10 mm diameter bore 40, is shown in the following Table II.

TABLE II

| | Slot dimensions | | inlet diameter | |
|---|---|---|---|---|
| | mm | in | mm | In |
| width | 3 | 0.11811 | 10 | 0.393701 |
| depth | 1.6 | 0.062992 | | |
| area | 4.8 | 0.00744 | | |
| Number | 16 | 16 | 1 | 1 |
| Total area | 76.8 | 0.11904 | 78.53982 | 0.121737 |

As shown in FIG. 3, channels 34 may be disposed in either a clockwise or counterclockwise orientation, depending on the desired direction of rotation of grinding wheel 10. For example, a set of channels 34, denoted as 34*a*, may be spaced circumferentially along grinding face 12, extending radially outward in a substantially clockwise spiral pattern. This clockwise orientation may be optimal for wheels rotated counterclockwise during operation. Similarly, the channels (or a second set of channels 34*b* as shown) may spiral in the opposite direction (i.e., counterclockwise), for use when wheel 10 is operated with a clockwise rotation.

Although exemplary dimensions are provided herein for both gap 58 (between body portion 48 and flange 52) and channels 34, it should be recognized that gap 58 may be reduced in size to as small as zero, i.e., so that the flange and the grinding face are nominally coterminous. In such a configuration, substantially all of the coolant may flow to the grinding face through channels 34.

Figure 4:
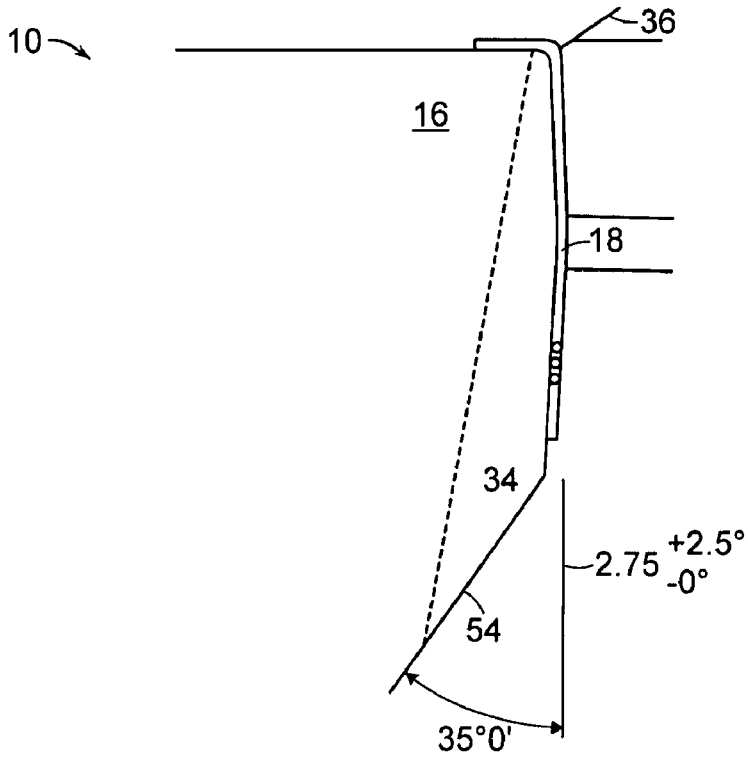
FIG. 4 is a side elevational cross-sectional view, on a further enlarged scale, of another portion of the grinding wheel of FIG. 2A.

As best shown in FIG. 4, grinding face 12 may include a single layer 18 of abrasive bonded to a face of body 16. Substantially any single layer of abrasive may be used in combination with a wide range of bond materials. For example, layer 18 may include diamond abrasive and/or CBN (cubic boron nitride) bonded in a braze to body 16. Alternatively, the single layer of abrasive may be electroplated onto body 16. In such single layer abrasive wheels, the (axial) height of the abrasive should be kept nearly uniform to minimize wheel "runout" (i.e., to minimize any tendency for the grinding face to wobble or otherwise run out of true during operation). The wheel may be finished to substantially reduce any runout by conventional grinding or machining to eliminate protruding grains and/or by using shim stock beneath individual segments as will be discussed hereinafter.

Advantageously, wheels comprising a metallic substrate (body) 16 onto which single layer of abrasive 18 is applied, generally do not require conventional truing or dressing and thus may be desired in many applications. In addition, however, many other types of abrasive articles may be used in the grinding wheel 10, provided they are compatible with the particular coolant used. These abrasive articles may be in the form of a continuous rim with channels 34, or in the form of abrasive segments. For example, conventional vitrified bond matrix containing abrasive or superabrasive grain may be used, provided it has sufficient strength and tool life to grind metallic components. A wheel utilizing conventional MMC (metal matrix composite) segments may also be used.

In this regard, substantially any abrasive grain may be used in the abrasive articles of this invention. Conventional abrasives may include, but are not limited to, fused, sintered and sol gel alumina grains, silica, silicon carbide, zirconia-alumina, garnet, and emery grains in grit sizes ranging from about 0.5 to about 5000 microns, preferably from about 2 to about 300 microns. Superabrasive grains, including but not limited to diamond and cubic boron nitride (CBN), with or without a metal coating, having substantially similar grit sizes as the conventional grains, may also be used.

Substantially any type of bond material commonly used in the fabrication of bonded abrasive articles may be used as a matrix or bond material in the abrasive article of this invention. For example, metallic, organic, resinous, or vitrified bond (together with appropriate curing agents if necessary) may be used.

Materials useful in a metal bond (e.g., as a braze or electroplating material with a single layer of abrasive) include, but are not limited to, copper, and zinc alloys (e.g., bronze, brass), cobalt, iron, nickel, silver, aluminum, indium, antimony, titanium, zirconium, chromium, tungsten, and their alloys, and mixtures thereof. A mixture of copper and tin in amounts satisfactory to form a bronze alloy is a generally desirable metal bond matrix composition in many applications. This bond material may be used with titanium or titanium hydride, chromium, or other known superabrasive reactive material capable of forming a carbide or nitride chemical linkage between the grain and the bond at the surface of the superabrasive grain under the selected sintering conditions to strengthen the grain/bond posts. Stronger grain/bond interactions generally reduce grain 'pullout' which tends to damage the workpiece and shorten tool life. Substantially any abrasive grain may be used in the abrasive articles of this invention.

As discussed hereinabove, it was discovered that in single layer abrasive wheels, a plurality of radially extending slots or channels 34 facilitate coolant flow. In the embodiment shown, the channels are formed in substrate 16 prior to application of the single abrasive layer 18. Thereafter, abrasive layer 18 may be applied to the substrate as described hereinabove. Alternatively, however, slots 34 may be formed by masking the substrate, as with a protective tape material, followed by application of a paste comprising the brazing components, and then removing the mask. The masked area will then be free of abrasive to effectively form the slots 34.

As shown in FIG. 4, grinding face 12 is preferably provided with a radius or chamfer 36 to help provide a smooth engagement of grinding wheel 10 with the workpiece and avoid scratching, particularly when wheel 10 is operated at an angle $\alpha$ as shown. As also shown, grinding face 12 is desirably formed integrally with body 16, to thus enable manufacture using as few discrete parts as possible. Flange 52 may also be fabricated integrally with body 16, though in desired embodiments, flange 52 is fabricated as a separate component removably fastened to body 16, such as with threaded fasteners as shown. Such removable construction enables flange 52 to be used repeatedly in multiple grinding wheels. This construction also enables the flange to be removed, if necessary, for cleaning. In desired embodiments, body 16 and flange 52 are fabricated from steel (e.g., heat treated 4340 steel), but may be fabricated from substantially any other material having sufficient structural integrity, such as aluminum, titanium, alloys thereof, and reinforced or high molecular weight plastics.

In some applications, it may be desirable to fabricate grinding face ring 12 as a detachable (e.g., disposable) and/or multi-part assembly, such as in two semicircular, 180 degree portions, four 90 degree portions, such as demarked by phantom lines 35 in FIG. 3, or some other configuration in order to prevent or ameliorate the accumulation of stresses that may occur during high rotational speed testing. Grinding face 12 may thus be fabricated as a segmented wheel, utilizing either a single layer of abrasive on a segmented metallic substrate, or utilizing a porous bond matrix such as vitrified bonded abrasive segments. The segments may be fastened to body 16 in any suitable manner such as brazing, welding or mechanical fastening. Spacing between each segment may serve to form slots 34. An example of a mechanically fastened detachable grinding face ring 112 (either one-piece or segmented), including an abrasive layer 18', is shown in FIG. 2D.

Wheels 10 fabricated according to the subject invention advantageously enable workpieces to be "machined" and precision ground in one or two passes, an improvement over prior art operations requiring two to four finishing steps. Moreover, wheel performance in a particular application may be further enhanced by adjusting various wheel parameters. Parameters such as the abrasive grit size utilized in layer 18 may be chosen by balancing desired surface finish with wheel life. Smaller grit sizes tend to produce fewer burrs and surface defects, but tend to promote shorter wheel life. For example, superabrasive (e.g., diamond, CBN) grit sizes of about 1 to 1181 microns, may be used, with grit sizes of about 1 to 252 microns used for precision applications. In other applications, superabrasive grit sizes in a range of 381 to about 1015 microns may be used. For conventional abrasives (i.e., non-superabrasive), grit sizes of about 3 to 710 microns may be desired. Particular embodiments may use conventional grit sizes of about 142 to 266 microns.

The following illustrative examples are intended to demonstrate certain aspects of the present invention, but are not intended to be limiting. All of the wheels in the Examples were Type 6A2 cup shaped wheels as shown in FIG. 1, with a 10.8 cm outer diameter. They were all tested by grinding an iron workpiece under conditions shown in the following Table III, and produced results summarized in the following Table IV. The results were achieved using a single grinding process, in lieu of the two-step milling/grinding process of the prior art.

TABLE III

| Grinding Conditions | |
|---|---|
| Machine: | Makino J77 Milling Center |
| Mode: | Face Milling Surface Grind |
| Depth of Cut: | .10 mm |
| Table Speed: | 2000 mm/min |
| Wheel Speed: | 4500 mm/min |
| Coolant: | Water soluble w/5% rust inhibitor filtered to 25 microns |
| Workpiece Material: | Ductile Iron |
| Flatness of Workpiece: | .012 mm |
| Surface Roughness of Workpiece: | 1.0 micron |

TABLE IV

| Results | |
|---|---|
| Example 1: (Comparative Grinding Wheels) | Achieved 400-500 parts per wheel in a one-step grinding process |
| Example 2: (Invention I) Coolant Flange closest to body at Flange outer diameter | Achieved 800-900 parts per wheel for a 60 to 125 percent improvement in tool life relative to Example I grinding wheel in a one-step grinding process |
| Example 3: (Invention II) Coolant Flange and Channels extending through face, past Flange outer diameter | Achieved 2200-2300 parts per wheel for a 340 to 475 percent improvement in tool life relative to Example I grinding wheel in a one-step grinding process |

EXAMPLE 1

Comparative Wheels—Conventional Type 6A2 cup face grinding wheels, were fabricated from heat treated 4340 steel, substantially as shown in FIGS. 2A, 2B, and 4, without channels 34 extending into grinding face 12. The outer diameter 62 of the wheels was 114.3 mm, the inner diameter 50 of face 12 was 74.8 mm. The wheels had a flange with a periphery located further than approximately 20 mm from the inner diameter 50 of the grinding face. The wheel face 12 was provided with a single layer 18 of electroplated CBN (Cubic Boron Nitride) grain.

EXAMPLE 2

Invention Wheels I—Grinding wheels were substantially similar to the wheels of Example I, while also including flanges 52 each having a periphery located 20 mm or less from the inner diameter of the grinding face. These wheels did not include channels 34 extending radially outward of flange periphery 51. These wheels were provided with converging walls 54 and 56 as shown in FIG. 2A, disposed at an angle of 3 degrees to one another ($\beta$=55 degrees, $\gamma$=58 degrees) to form a gap 58 of about 0.5 mm between inner diameter 50 of face 12 and the periphery 51 of the flange. The outer diameter 62 of the wheels was 114.3 mm, the inner diameter 50 of face 12 was 74.8 mm, and the outer diameter of the flanges was 73.8 to provide the 0.5 mm gap 58. The transverse cross-sectional area of annular gap 58 (about 117 $mm^2$), was about 149 percent that of bore 40 (about 79 $mm^2$). This configuration was observed to improve the laminarity of flow and yield significant grinding performance improvements (see Table IV) relative to that of Example 1.

EXAMPLE 3

Invention Wheels II were substantially similar (including flanges 52) to wheels of Example 2, but were equipped with X-shaped slots or channels 34 as shown and described with respect to FIG. 3, extending into the grinding face from a point radially inward of the outer diameter of the flange 52. The channels were 2.5 mm wide and up to 2 mm deep. The diameter 60 of axial bore 40 was 10 mm. These wheels yielded further significant grinding performance improvements as per Table IV.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described the invention, what is claimed is:

1. An abrasive grinding tool comprising:

a grinding wheel having an annular grinding face depending from a substantially circular body;

said body configured for being operably engaged by a machine spindle for rotation about a central axis;

said body having a tubular innermost wall defining an axial bore configured to convey coolant in a downstream direction therethrough from a proximal end to a distal end thereof;

said innermost wall coupled to a concave body portion terminating at an inner periphery of the annular grinding face;

a flange disposed within the concave body portion, in superposed orientation therewith;

said flange having an outer periphery disposed within about 20 mm of the inner periphery of said grinding face;

said flange and said concave body portion defining a fluid flow passage therebetween, the fluid flow passage being in fluid communication with said axial bore and with said grinding face;

said fluid flow passage having a minimum transverse cross-sectional area less than or equal to about 300 percent that of said bore;

wherein during operable rotation of the grinding wheel, coolant flowing downstream through the bore is conveyed radially outward into said fluid flow passage for delivery to the grinding face.

2. The grinding tool of claim 1, wherein said outer periphery of said flange is disposed within about 10 mm of the inner periphery of said grinding face.

3. The grinding tool of claim 1, wherein said outer periphery of said flange is disposed within about 5 mm of the inner periphery of said grinding face.

4. The grinding tool of claim 1, comprising a medial fluid flow passage communicably coupling said axial bore to said fluid flow passage.

5. The grinding tool of claim 4, wherein said medial fluid flow passage comprises a portion of said innermost wall extending radially outward and downstream from the distal end of said bore.

6. The grinding tool of claim 4, wherein said medial fluid flow passage comprises a plurality of pathways extending through said body.

7. The grinding tool of claim 4, wherein said medial fluid flow passage comprises an upstream portion of said concave body portion.

8. The grinding tool of claim 4, wherein said medial fluid flow passage is disposed between said bore and said minimum transverse cross-sectional area, said medial fluid flow passage having a transverse cross-sectional area greater than said minimum transverse cross-sectional area.

9. The grinding tool of claim 1, comprising a coupling fastened to said body, said coupling configured for being operably engaged by a milling machine spindle.

10. The grinding tool of claim 1, wherein said body and said grinding face form a unitary component.

11. The grinding tool of claim 1, wherein said grinding face comprises a plurality of segments disposed in spaced relation about a periphery of said grinding wheel.

12. The grinding tool of claim 1, wherein the concave body portion comprises a frusto-conical wall disposed at an acute angle to the central axis.

13. The grinding tool of claim 12, wherein the flange comprises a frusto-conical wall disposed at an acute angle to the central axis, the acute angle being parallel to the angle of the frusto-conical wall of the concave body portion.

14. The grinding tool of claim 12, wherein the flange comprises a frusto-conical wall disposed at an acute angle to the central axis, the angle of the flange wall being larger than the angle of the frusto-conical wall of the concave body portion, wherein the flange wall and the frusto-conical wall of the concave body portion are not parallel and converge at the downstream portion of the fluid flow passage without blocking the fluid flow passage.

15. The grinding tool of claim 1, further comprising a plurality of channels disposed in fluid communication with said grinding face and said fluid flow passage.

16. The grinding tool of claim 15, wherein said channels are disposed within said grinding face.

17. The grinding tool of claim 15, wherein said plurality of channels extend into the fluid flow passage.

18. The grinding tool of claim 15, wherein said plurality of channels extend radially inward of the periphery of said flange.

19. The grinding tool of claim 18, wherein said outer periphery of said flange is coterminous with the inner periphery of said grinding face.

20. The grinding tool of claim 1, wherein said grinding face comprises a single layer of abrasive disposed within a bond material.

21. The grinding tool of claim 1, wherein said grinding face comprises abrasive grain selected from the group consisting of alumina, silica, silicon carbide, zirconia-alumina, garnet, emery, diamond, and cubic boron nitride (CBN), disposed within a bond selected from the group consisting of organic, resinous, and vitrified bond, bronze, brass, copper, tin, zinc, cobalt, iron, nickel, silver, aluminum, indium, antimony, titanium, zirconium, chromium, tungsten, and their alloys, and mixtures thereof.

22. The grinding tool of claim 21, wherein said grains have a grit size within a range of:

at least about 1 micron; and up to about 1181 microns.

23. The grinding tool of claim 22, wherein said grains have a grit size within a range of:

at least about 3 microns; and up to about 710 microns.

24. The grinding tool of claim 1, wherein during operable rotation of the grinding wheel, coolant flowing downstream through the bore is conveyed radially outward into said fluid flow passage for delivery to the grinding face in a substantially laminar flow.

25. The grinding tool of claim 1, wherein said flange is unitary with said body.

26. A method for grinding a workpiece to form a flat surface, said method comprising:

(a) providing an abrasive face grinding wheel having an annular grinding face depending from a substantially circular body, the body configured for being operably engaged by a machine tool spindle for rotation about a central axis, the body having a tubular inner wall defining an axial bore configured to convey coolant in a downstream direction therethrough from a proximal end to a distal end thereof, the inner wall coupled to a concave body portion terminating at an inner periphery of the annular grinding face, a flange disposed within the concave body portion, in superposed orientation therewith, said flange having an outer periphery disposed within about 20 mm of an inner periphery of said grinding face; said flange and said concave body portion defining a fluid flow passage therebetween, said fluid flow passage being in fluid communication with said axial bore and with said grinding face, said fluid flow passage having a transverse cross-sectional area less than or equal to about 300 percent that of said bore;

(b) orienting the central axis at a predetermined angle $\alpha$ relative to the workpiece;

(c) rotating the grinding wheel about the central axis;

(d) delivering coolant flow downstream through the bore, for conveyance radially outward through the fluid flow passage for delivery to the grinding face in a substantially laminar flow;

(e) translating the grinding wheel towards the workpiece along a tool path parallel thereto, wherein said grinding face engages and removes material from the workpiece.

27. The method of claim 26, wherein a medial fluid flow passage communicably couples the axial bore to the fluid flow passage.

28. The method of claim 27, wherein said medial fluid flow passage is disposed between said bore and said minimum transverse cross-sectional area, said medial fluid flow passage having a transverse cross-sectional area greater than said minimum transverse cross-sectional area.

29. The method of claim 26, wherein said abrasive face grinding wheel has a plurality of channels disposed in fluid communication with said grinding face and said fluid flow passage.

30. The method of claim 29, wherein said channels are disposed within said grinding face and extend into the fluid flow passage.

31. The method of claim 26, wherein said grinding face comprises a single layer of abrasive disposed within a bond material.

32. The method of claim 26, wherein the grinding face comprises abrasive disposed within a vitrified matrix.

33. The method of claim 26, wherein said angle $\alpha$ is oblique.

34. A grinding system comprising:

an abrasive face grinding wheel having an annular grinding face depending from a substantially circular body;

the body configured for being operably engaged by a machine tool spindle for rotation about a central axis;

the body having a tubular innermost wall defining an axial bore configured to convey coolant in a downstream direction therethrough from a proximal end to a distal end thereof;

the inner wall extending to a concave body portion terminating at an inner periphery of the annular grinding face;

a flange disposed within the concave body portion, in superposed orientation therewith;

said flange and said concave body portion defining a fluid flow passage therebetween;

said fluid flow passage having a transverse cross-sectional area less than or equal to about 300 percent that of said bore;

a plurality of channels disposed within said grinding face and extending radially inward of the periphery of said flange, wherein said plurality of channels is disposed in fluid communication with said grinding face and with said fluid flow passage;

wherein during operable rotation of the grinding wheel, coolant flowing downstream through the bore is conveyed radially outward into said fluid flow passage and into said plurality of channels for delivery to the grinding face.

35. A method for grinding a workpiece to form a flat surface, said method comprising:

(a) providing an abrasive face grinding wheel having an annular grinding face depending from a substantially circular body, the body configured for being operably engaged by a machine tool spindle for rotation about a central axis, the body having a tubular innermost wall defining an axial bore configured to convey coolant in a downstream direction therethrough from a proximal end to a distal end thereof, the innermost wall coupled to a concave body portion terminating at an inner periphery of the annular grinding face, a flange disposed within the concave body portion, in superposed orientation therewith, said flange and said concave body portion defining a fluid flow passage therebetween, said fluid flow passage being in fluid communication with said axial bore and with said grinding face, said fluid flow passage having a transverse cross-sectional area less than or equal to about 300 percent that of said bore; said flange having an outer periphery disposed sufficiently close to an inner periphery of said grinding face to maintain laminar coolant flow at a point of grinding;

(b) orienting the central axis at a predetermined angle $\alpha$ relative to the workpiece;

(c) rotating the grinding wheel about the central axis;

(d) delivering coolant flow downstream through the bore, for conveyance radially outward through the fluid flow passage for delivery of laminar coolant flow to the point of grinding;

(e) translating the grinding wheel towards the workpiece along a tool path parallel thereto, wherein said grinding face engages and removes material from the workpiece.

* * * * *

UNITED STATES PATENT AND TRADEMARK OFFICE

CERTIFICATE OF CORRECTION

PATENT NO. : 7,384,329 B2
APPLICATION NO. : 11/438960
DATED : June 10, 2008
INVENTOR(S) : Brian P. Rutkiewicz et al.

It is certified that error appears in the above-identified patent and that said Letters Patent is hereby corrected as shown below:

In column 13, claim 26, line 26, change “inner” to --innermost--.

In column 13, claim 26, line 29, change “inner” to --innermost--.

In column 13, claim 26, line 38, insert --minimum-- before “transverse cross-sectional area”.

In column 14, claim 34, line 14, change “inner” to --innermost--.

In column 14, claim 34, line 21, insert --minimum-- before “transverse cross-sectional area”.

In column 14, claim 35, line 49, insert --minimum-- before “transverse cross-sectional area”.

Signed and Sealed this

Sixteenth Day of September, 2008

JON W. DUDAS
*Director of the United States Patent and Trademark Office*